US005094623A

United States Patent [19]

Scharf et al.

[11] Patent Number: 5,094,623

[45] Date of Patent: Mar. 10, 1992

[54] CONTROLLED IMPEDANCE ELECTRICAL CONNECTOR

[75] Inventors: Robert M. Scharf, Greer; Matthew J. Fadule, Spartanburg; Robert Brush, Inman, all of S.C.

[73] Assignee: Thomas & Betts Corporation, Bridgewater, N.J.

[21] Appl. No.: 693,740

[22] Filed: Apr. 30, 1991

[51] Int. Cl.[5] ..... H01R 23/70

[52] U.S. Cl. ..... 439/101; 439/65; 439/607

[58] Field of Search ..... 439/62, 65, 74, 79, 439/101, 607

[56] References Cited

U.S. PATENT DOCUMENTS

| | | | |
|---|---|---|---|
| 242,894 | 6/1881 | Delaney | 174/104 |
| 305,854 | 9/1884 | Shaw | 174/103 |
| 369,372 | 9/1887 | Turner | 174/104 |
| 3,179,904 | 4/1965 | Paulsen | 333/1 |
| 3,277,422 | 10/1966 | Shevlin | 339/65 |
| 3,621,377 | 11/1971 | Lim | 323/93 |
| 4,012,099 | 3/1977 | Worcester | 339/75 |
| 4,148,543 | 4/1979 | Shores | 339/143 |
| 4,232,929 | 11/1980 | Zobawa | 339/143 |
| 4,655,518 | 4/1987 | Johnson et al. | 339/17 |
| 4,678,251 | 7/1987 | Willard | 439/61 |
| 4,686,607 | 8/1987 | Johnson | 439/65 X |
| 4,693,530 | 9/1987 | Stille et al. | 439/67 |
| 4,705,332 | 11/1987 | Sadigh-Behzadi | 439/69 |
| 4,762,500 | 8/1988 | Dola et al. | 439/79 |
| 4,806,110 | 2/1989 | Lindeman | 439/65 X |
| 4,820,175 | 4/1989 | Hasegawa et al. | 439/98 |
| 4,836,791 | 6/1989 | Grabbe et al. | 439/79 |
| 4,847,443 | 7/1989 | Basconi | 174/32 |
| 4,861,272 | 8/1989 | Clark | 439/79 |
| 4,869,676 | 9/1989 | Demler, Jr. et al. | 439/79 |
| 4,871,321 | 10/1989 | Johnson | 439/79 |
| 4,881,905 | 11/1989 | Demeler, Jr. et al. | 439/79 |
| 4,906,194 | 3/1990 | Grabbe | 439/71 |
| 4,917,616 | 4/1990 | Demler, Jr. et al. | 439/101 |
| 4,932,885 | 6/1990 | Scholz | 439/79 |
| 4,932,888 | 6/1990 | Senor | 439/108 |
| 4,939,624 | 7/1990 | August et al. | 361/424 |

FOREIGN PATENT DOCUMENTS 1078657 5/1954 France .

OTHER PUBLICATIONS

Connection Technology, "A Flexible Circuit Controlled Impedance Interconnect System", Jun. 1990, pp. 27–30.

IBM Technical Disclosure Bulletin, "Shielded Connector Assembly Using Metallized Plastic", vol. 30, No. 12, May 1988, pp. 84–85.

Rogers Corporation, "Innovators in Controlled Impedance Interconnections", 1986, 12 pp.

*Primary Examiner*—Eugene F. Desmond

*Attorney, Agent, or Firm*—Robert M. Rodrick; Salvatore J. Abbruzzese

[57] ABSTRACT

The controlled impedance, low cross-talk, high density, EMI shielded electrical connector assembly comprises a receptacle connector and a plug connector for interconnecting circuits on mother and daughter printed circuit boards arranged orthogonally or in other configurations. Each of the receptacle and plug connectors comprises in preferable form, four rows of electrical contacts arranged in two outer and two inner rows. One set of inner rows and outer rows is each supported in an insulator of dielectric material which surrounds each contact and extends between an outer and inner row in each set. The contacts in the outer rows of each set are staggered with respect to the contacts in the inner rows. A conductive housing extends along the outer rows of contacts and further comprises a portion disposed adjacent the inner rows of contacts, the housing serving as a ground plane when connected to the boards. The ground plane is spaced from the contacts at a selected distance that when combined with the dielectric material of the insulators provides a selected characteristics impedance. Further, the conductive housing has a plurality of projections extending inwardly toward the outer rows of contacts and outwardly toward the inner rows of contacts, the projections extending partially between each of the adjacent contacts in the respective rows to provide a conductive barrier for cross-talk protection.

20 Claims, 4 Drawing Sheets

CONTROLLED IMPEDANCE ELECTRICAL CONNECTOR

FIELD OF THE INVENTION

The present invention relates to electrical connectors and more specifically to a high speed, high density, controlled impedance, low cross-talk, shielded connector suitable for use in interconnecting mother and daughter circuit boards.

BACKGROUND OF THE INVENTION

One of the trends in present electronic systems is the development of high speed digital circuits with a relatively large number of circuit interconnects between circuit boards. In addition to such higher operating speeds, increased circuit density and faster signal rise times are placing greater demands on circuit designers. Signal transmission in such faster, higher speed digital processing systems for computer applications and the like are thus becoming increasingly complex. The overall efficiency of signal transmission is affected by each element of the system, for example, the integrated circuit, printed circuit boards, electrical connectors, as well as the interfaces between each element. Maintaining the efficiency and integrity of a signal from a motherboard to a daughterboard in a high speed environment involves consideration of impedance control and cross-talk.

Impedance characteristics are typically determined by transmission line geometry and dielectric properties of the materials in the transmission line circuit. The characteristic impedance of a transmission line circuit is a significant factor in determining the performance of high speed designs. For example, when a signal is reflected back to its source due to a discontinuity caused by an electrical connector or interface in a circuit, such reflections may lead to waveform distortions, which may in turn cause loss in power of the transmitted signal, cross-talk in adjacent lines, and difficulty in transmitting consecutive signals. Cross-talk in a transmission line circuit introduces undesirable signals which cause unpredictable consequences. Cross-talk can be internal resulting from an unwanted signal which may couple from one conductor to another Electromagnetic interference (EMI) may result from electronic noise picked up from an external field. Thus, the characteristic impedance, cross-talk and EMI parameters not only have to be considered in the design of printed circuit boards for desired transmission line signal efficiency, but the electrical connectors in the circuit must also address these parameters.

Present connection systems are frequently used to connect printed circuit boards that are removable. In such systems, a daughterboard may be interconnected through a connector assembly to a motherboard, the daughterboard being replaceable as needed. High pin count connector systems have been developed which locate connection devices, such as plugs or receptacles, for connection to the mother and daughterboards, on relatively close centers, for example 0.100 inches or less in a multi-row matrix so that a large number of circuit interconnects per connector is achieved.

One arrangement of a high density, controlled impedance electrical connector is shown in U.S. Pat. No. 4,917,616 to Demler, Jr., et al. In the device described in this patent, ground planes are dispersed between a plurality of signal pins such that the spacing between the pins and the ground planes is maintained substantially the same. Dielectric material is disposed between the ground planes and the pins, the geometric spacing combined with the value of the dielectric constant of the dielectric material thereby defining the characteristic impedance in a known manner. Other connectors with controlled impedance characteristics are shown, for example, in U.S. Pat. No. 4,881,905 to Demler, Jr., et al and U.S. Pat. No. 4,869,676 to Demler, Jr., et al. In these patents, the controlled impedance is described to be provided by the use of a cast metal housing which places a ground plane equally spaced from the individual signal pins. Other examples of controlled impedance connectors are shown in U.S. Pat. No. 4,836,791 to Grabbe, et al and U.S. Pat. No. 4,762,500 to Dola, et al.

While the known electrical connectors are useful in controlling impedance characteristics and cross-talk parameters, there is a further need to provide higher density pin count in such controlled impedance environments. For example, while known controlled impedance, shielded electrical connectors have pin counts on the order of 40 signal contacts per linear inch of connector, it is desirable to have pin counts on the order of 75–80 signal contacts per linear inch.

SUMMARY OF THE INVENTION

It is an object of the present invention to provide an electrical connector having controlled impedance, low cross-talk and EMI shielding capability.

It is a further object of the present invention to provide an electrical connector assembly interconnecting mother and daughter printed circuit boards with a separable interface.

In accordance with a preferred form of the invention, an electrical connector for use in electrically interconnecting circuits on two printed circuit boards is provided. The connector is electrically mateable with a complementary connector that is electrically connected to one of the circuit boards. The electrical connector comprises a plurality of contacts arranged in two, substantially parallel, elongate rows, the contacts in one row being staggered with respect to contacts in the other row. Each contact includes a tail portion for electrical engagement with a circuit on the other of the circuit boards and an opposing mateable terminal portion for electrical engagement with a contact of the complementary connector. An insulator supports the two rows of contacts, the insulator being formed of dielectric material that surrounds each of the contacts and extends between each row of contacts. A conductive housing is provided on the insulator and extends along the insulator exteriorly of the rows of contacts and is spaced from each row of contacts a distance to provide, with the dielectric constant of the material of the insulator, a selected characteristic impedance. A plurality of conductive members are provided in engagement with the housing, the conductive members extending transversely into the insulator from the exterior thereof and partially between each of the respective contacts so as to provide a conductive barrier for minimizing cross-talk between adjacent contacts within a row.

In accordance with a more specific aspect of the present invention, an electrical connector assembly for use in electrically interconnecting a motherboard and a daughterboard in an orthogonal manner comprises a receptacle connector and a plug connector. The receptacle connector comprises an elongate insulator of dielectric material supporting at least two, substantially parallel rows of contacts, each contact having a tail portion projecting from the insulator for engagement with a circuit on the motherboard. Each contact further includes an opposing mateable terminal portion. The contacts in the rows are longitudinally staggered relative to each other. A conductive housing supports the insulator and has a plurality of projections extending transversely toward and partially between the contacts in each row. A portion of the insulator extends outwardly beyond the housing. The plug connector comprises an elongate insulator of dielectric material supporting at least two, substantially parallel rows of contacts. Each contact has a tail portion projecting from the insulator for engagement with a circuit on the daughterboard. Each contact further includes an opposing terminal portion disengageably mated with a respective mateable terminal portion of the receptacle connector. The contacts in the rows in the plug connector insulator are longitudinally staggered relative to each other. A conductive housing supports the insulator and has a plurality of projections extending transversely toward and partially between the contacts in each row. A portion of the housing extends outwardly beyond the insulator and exteriorly over the portion of the insulator projecting outwardly beyond the receptacle connector housing.

BRIEF DESCRIPTION OF THE DRAWINGS

FIG. 3(*b*) is a plan view of the plug connector of FIG. 3(*a*).

FIG. 5(*b*) is a plan view of the receptacle connector shown in FIG. 5(*a*).

DETAILED DESCRIPTION OF THE PREFERRED EMBODIMENT

Figure 1:
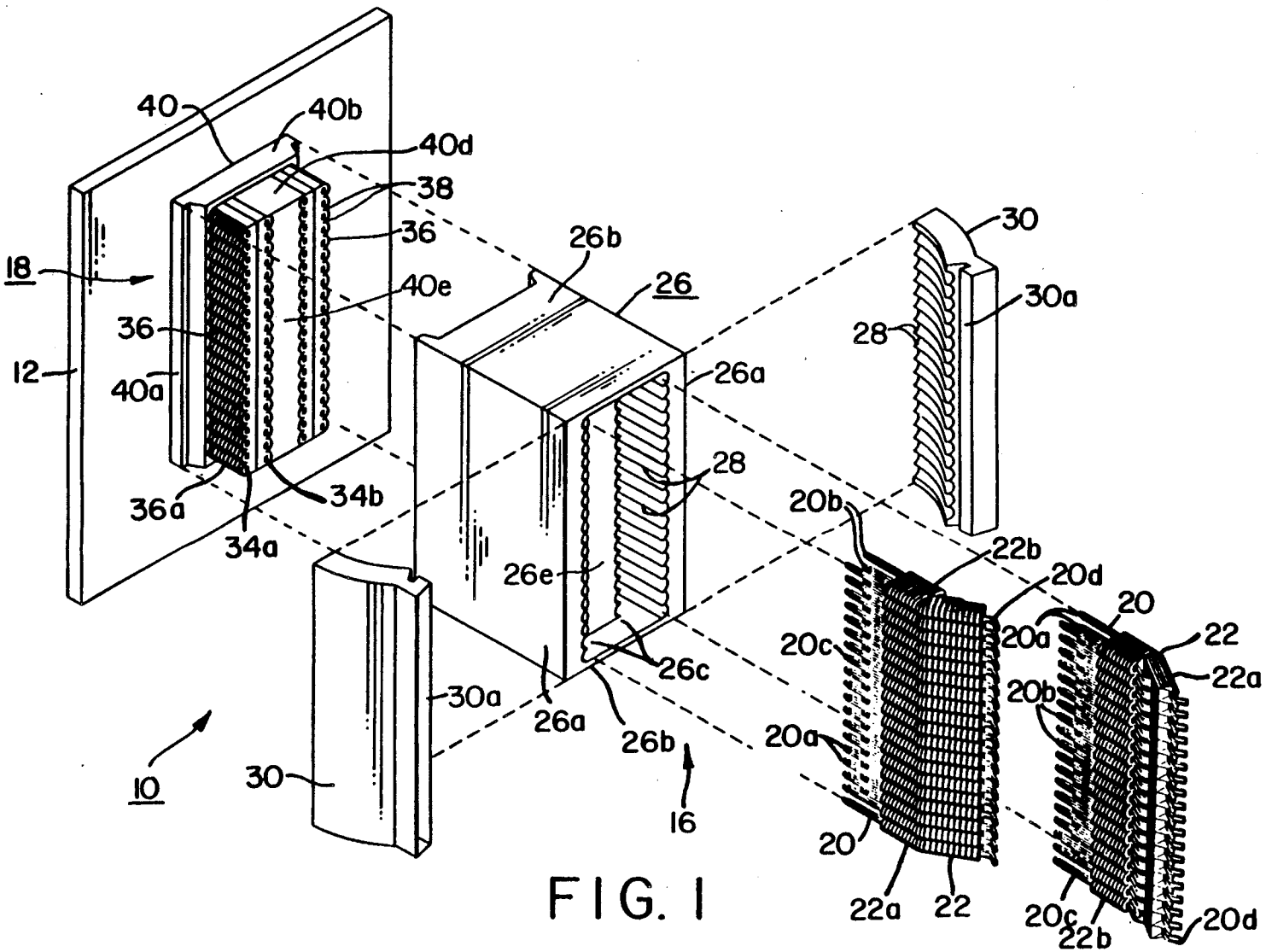
FIG. 1 is an exploded perspective view of the electrical connector assembly in accordance with a preferred form of the invention.
Figure 2:
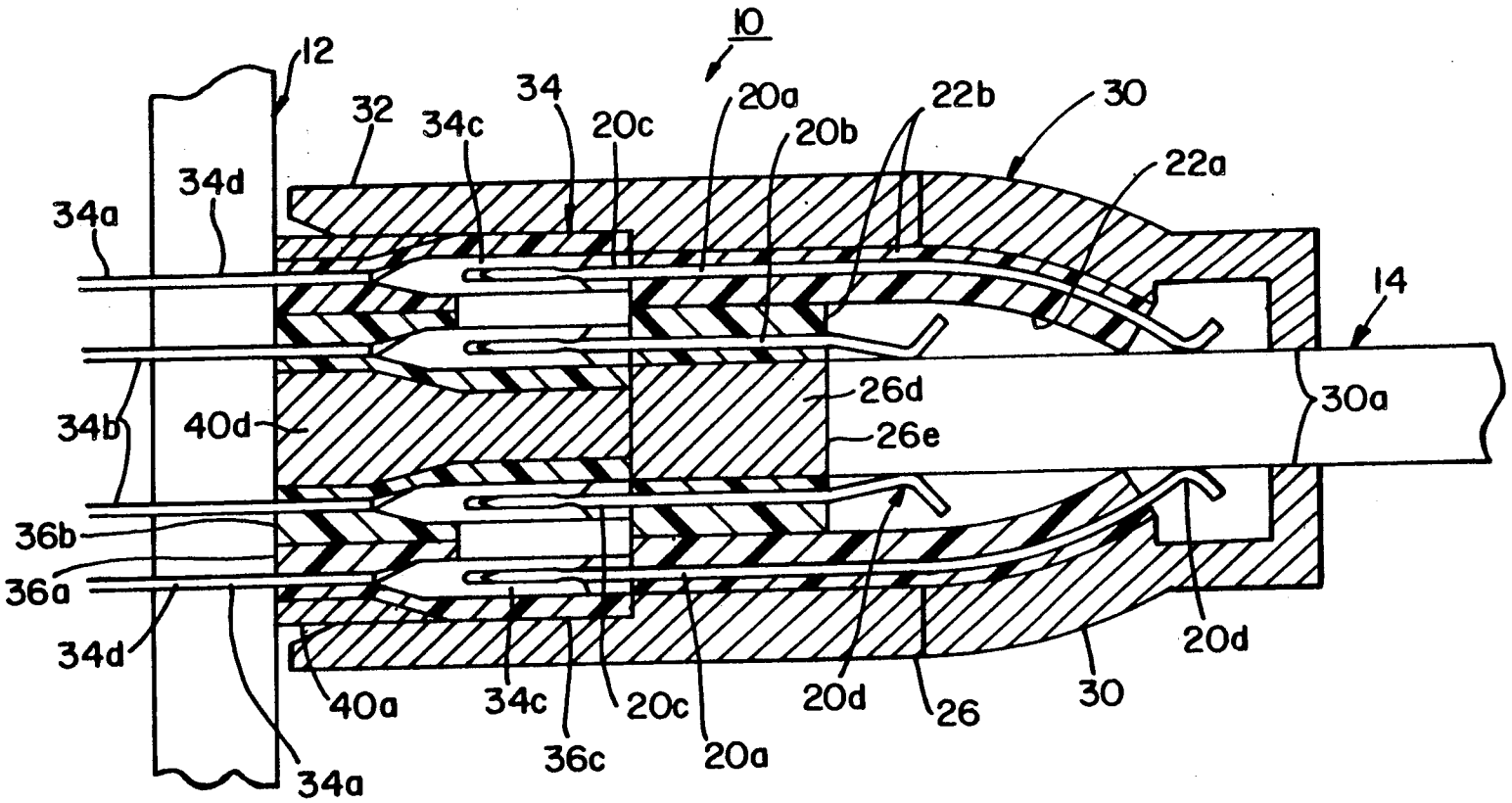
FIG. 2 is a sectional view of the assembly of FIG. 1 shown in assembled fashion and interconnecting a motherboard and a daughterboard in an orthogonal manner.

Referring now to the drawing figures, there is shown in FIGS. 1 and 2 a two-piece electrical connector assembly 10 for use in electrically interconnecting electrical circuits on a motherboard 12 to electrical circuits on a daughterboard 14. Electrical connector assembly 10 provides, in accordance with the instant invention, a controlled impedance, low cross-talk, high density, EMI shielded device capable of transmitting signals with rise times less than 500 picoseconds between the motherboard 12 and daughterboard 14. Motherboard 12 may typically be a backplane printed circuit board of a computer which may have a characteristic impedance of 50 ohms or some other specified characteristic impedance to which the connector assembly 10 is desirably matched. Daughterboard 14 may be a printed circuit board which contains logic, memory or input/output (I/O) circuitry used to process electrical signals received from the motherboard 12. In the preferred form of the invention, the connector assembly 10 is arranged to be removably attachable to both the motherboard 12 and the daughterboard 14. Further, the connector assembly 10 is constructed to electrically interconnect the daughterboard 14 to the motherboard 12 in the commonly utilized orthogonal arrangement.

The electrical connector assembly comprises a plug connector 16 and a receptacle connector 18 that are, in the preferred form, provided with complementary structure as will be described to enable separable mating thereof. In FIG. 1, the plug connector 16 is shown in exploded, disassembled fashion, while the receptacle connector 18 is illustrated in assembly and attached to the motherboard 12. By further reference to FIGS. 3(*a*) and 3(*b*) and FIG. 4, the details of the plug connector 16 are now more fully described.

Plug connector 16 includes a plurality of electrical contacts 20 arranged as illustrated in the preferred embodiment, in four substantially parallel, elongate rows, although other arrangements may be suitably used. Contacts 20 are electrically conductive and may comprise resilient material, preferably a copper alloy metal, such as beryllium copper or phosphor bronze. The electrical contacts in the depicted construction are supported in insulators 22 in two sets of two rows each. Two rows of contacts are supported by each insulator 22 such that one row of contacts 20*a* forms an outer row while another row of contacts 20*b* forms an inner row. Each insulator is formed of dielectric material, as will be set forth more fully hereinafter, and fully surrounds each of the contacts 20 with dielectric material extending between each row of contacts 20*a* and 20*b*.

Each of the contacts 20 is formed to have a terminal portion 20*c* which is disengageably mateable with a complementary contact of the receptacle connector 18. In the illustrated arrangement, terminal portions 20*c* are provided as a male pin. Each electrical contact has at its opposing end a tail portion 20*d* that is supported by the insulator 22 in a cantilevered fashion and which terminates in a curved section for resilient, surface mount pressure contact with electrical circuits on the daughterboard 14. The outer row of contacts 20*a* are formed to be longer than the inner row of contacts 20*b*. The pressure contact construction of the tail portions 20*d* permits removable connection to the daughterboard 14 and facilitates use with daughterboards of different sizes, such as thicknesses of 0.0625 inch, 0.093 inch and 0.125 inch. If removeability is not desired, tail portions 20*d* may be permanently attached to the board by soldering, welding or by conductive adhesive applications.

Figure 3A:
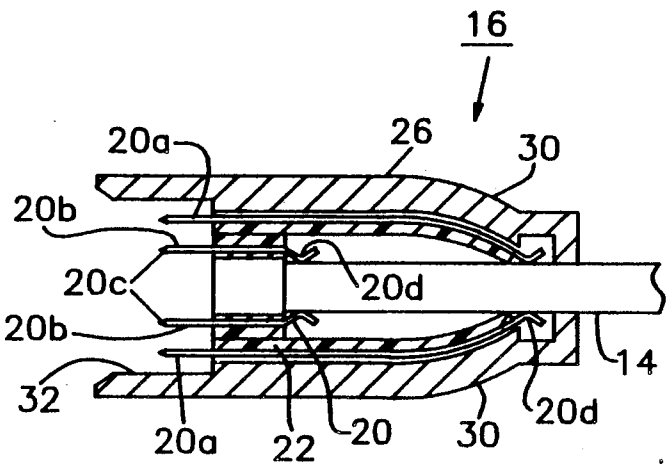
FIG. 3(*a*) is a separate view of the plug connector of the connector assembly shown in FIG. 2.
Figure 3B:
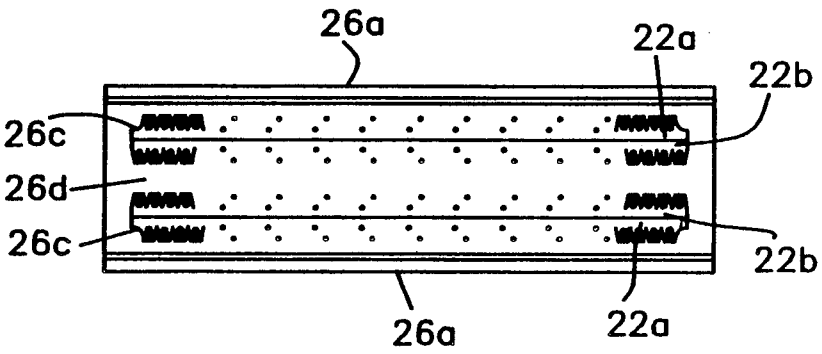
Figure 4:
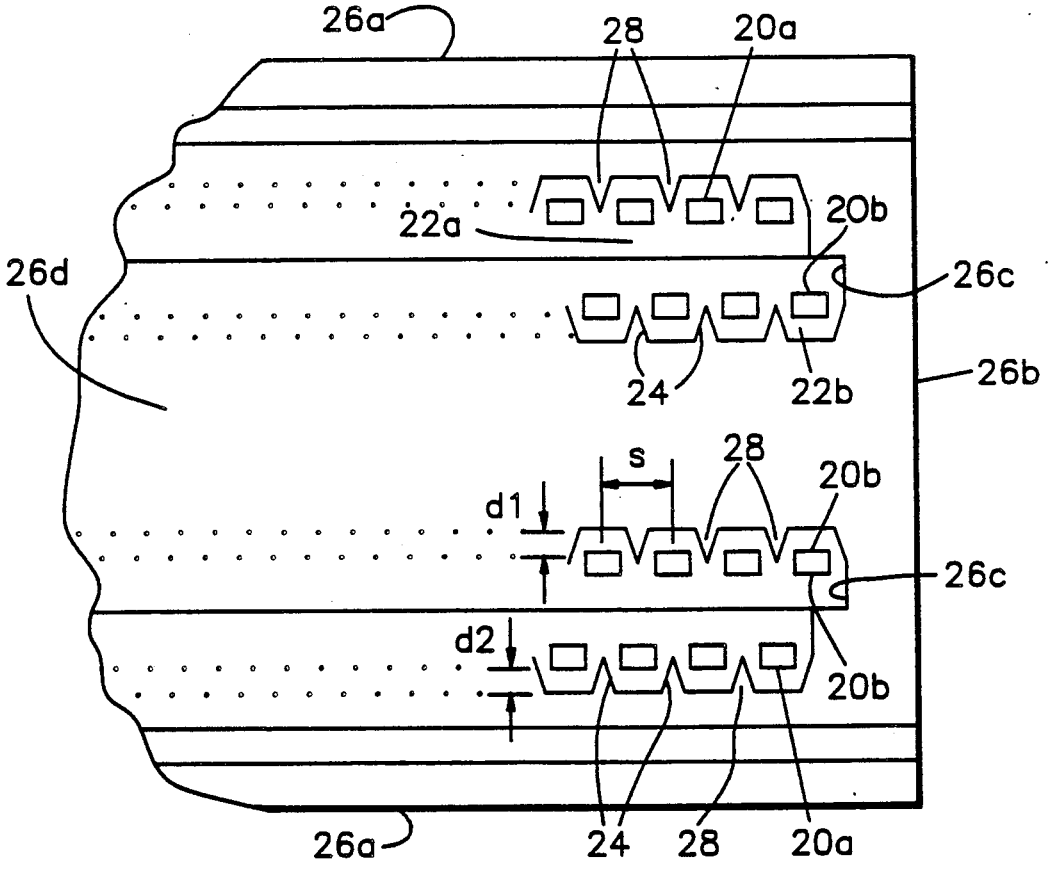
FIG. 4 is a fragmentary, enlarged view of a portion of the plug connector of FIG. 3(*b*) showing construction features in greater detail.

As seen by reference further to FIGS. 3(*b*) and FIG. 4, the contacts 20*a* in the outer row of contacts 20 are staggered longitudinally relative to the inner row of contacts 20*b* in each set of contacts, in a manner to provide a high density pin count. For example, where the spacing, s, between adjacent contacts in a row is provided on 0.050 inch centers, the staggering of contacts 20*a* and 20*b* effectively provides center spacings of 0.025 inches for the two rows. Thus, in a four row connector arrangement pin count density of 80 pins per linear inch can be achieved.

The insulators 22 are generally elongate in supporting the two rows of contacts 20*a* and 20*b*. The insulators may be formed by conventional molding or extruding techniques, and may be formed unitarily around both rows of contacts 20*a* and 20*b*, or in two separate strips. For example, as illustrated in FIGS. 1 and 4, one insulator strip 22a may be formed to support the outer row of contacts 20a while another insulator strip 22b may support the inner row of contacts 20b. Whether formed as a one piece insulator or a composite insulator, dielectric material extends further along the longer outer contacts 22a than along the shorter inner contacts 22b. The curved section, pressure contact tails 20d, may remain exposed and free from dielectric material so as to make conductive contact with circuits on the daughterboard 14.

Each insulator, such as insulator strip 22a and 22b as illustrated in FIG. 4, is further formed to have a V-shaped notch 24 extending transversely between each of the adjacent electrical contacts 20a, 20b. The wider portion of the V-shaped notch 24 is disposed at the outside surface of the insulator with the opposite, pointed end of the V-shape projecting partially into the insulator and between the adjacent contacts.

By reference still to FIGS. 1, 2, 3(*a*) and 3(*b*) and 4, the plug connector 16 is shown as further comprising a conductive housing 26 for EMI shielding. Housing 26 is of generally rectangular shape and includes a pair of opposite, substantially planar side walls 26a and a pair of opposite transversely extending end walls 26b. Interiorly of the housing are formed a pair of spaced, elongate cavities 26c, with an interior housing section 26d extending therebetween. Interior section 26d has a surface 26e recessed within the sidewalls and endwalls of the housing.

The conductive housing 26 is formed to have extending transversely relative to the elongate cavities 26c a plurality of projections 28, preferably configured in complementary form to the notches 24 in the insulators 22. Each cavity 26c is constructed to receive therein an insulator set supporting a row of outer contacts 20a and a row of inner contacts 20b. The insulators 22 supporting each row of contacts 20a and 20b may be received in the cavities 26c in interference fit or otherwise suitably secured therein. In such assembly, the projections 28 thus extend from the exterior sidewalls 26a transversely into the notches 24 and thereby partially between adjacent contacts 20a. Similarly, the projections 28 project from the interior section 26d transversely into the notches 24 and partially between the adjacent contacts 20b in the inner rows. Thus, the projections 28 provide a suitable conductive barrier for minimizing cross-talk between adjacent contacts within each row. With such a construction, it is believed that cross-talk between adjacent contacts can be limited to approximately 2.5%, or less.

The conductive housing 26 further includes a pair of conductive back-shells 30 which are suitably attached thereto. Back-shells 30 are shown in an exploded manner in FIG. 1. The back-shells 30 are configured in a generally curved form to conform with the curvature of the longer outer rows of electrical contacts 20a and have extent to fully cover such outer contacts. Each back-shell 30 is likewise formed with a plurality of inwardly directed projections 28 that also extend into notches 24 that are provided within the extended lengths of insulation around the longer outer contacts 20a. As such, except for the terminal portions 20c and the pressure tail portion 20d of each contact, the outer contacts 20a and the inner contacts 20b are provided with inwardly directed projections 28 substantially along their lengths for protection against cross-talk coupling.

Each back-shell 30 is further provided with a termination end 30a that, together in assembly, form an opening for receipt of the daughterboard 14. Termination ends 30a further serve to support and thereby stiffen the mounting of the daughter-board 14 in the connector assembly 10. Additionally, the terminations ends 30a may be varied to adapt to different thicknesses of daughterboards. Also, ends 30a are suitably connected to ground traces on the daughterboard 14 so as to provide ground potential to the entire conductive housing 26 enabling the housing 26 to serve as a ground plane in the connector assembly 10.

As seen in FIG. 3(*a*), the conductive housing 26 is formed such that after assembly of the insulators 22 with contacts 20 supported therein, a section 32 extends outwardly beyond the insulators 22 and over the terminal portions 20c. Section 32 is preferably also formed to have projections 28 extending inwardly therefrom, the purpose of which will be described. The conductive housing 26 and its back-shells 30 are formed of a conductive material and are preferably a cast metal, such as zinc, aluminum or brass.

For purposes of the characteristic impedance, it can be seen that a ground plane extends exteriorly of the outer rows of contacts 20a as provided by both the housing sidewalls 26a and the back-shells 30, and that a ground plane likewise extends along the inner rows of contacts 20b as provided by the inner section 26d. As illustrated in FIG. 4, the spacing $d_1$ between the inner rows of contacts 20b and the ground plane and the spacing $d_2$ between the outer rows of contacts 20a and the ground plane are provided to be substantially the same along the length of such contacts, except for the terminal portions 20c and the tail portions 20d. Further, the material of the insulators 22 is selected to have a dielectric constant such that when considering the spacings $d_1$ and $d_2$ the characteristic impedance may be determined in accordance with recognized strip line transmission theory. By so constructing the plug connector 16, an impedance of 50 ohms for matching the characteristic impedance of the backplane may be achieved. Where the characteristic impedance of the backplane is an impedance other than 50 ohms, the spacings $d_1$ and $d_2$ as well as the dielectric constant of the insulator materials may be selected to provide a plug connector with such other desired impedance.

Figure 5B:
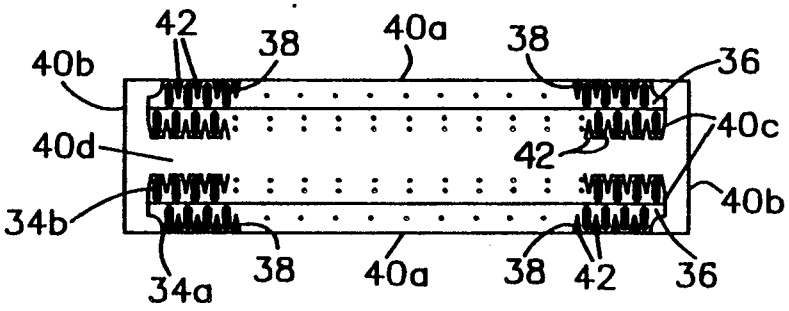
FIG. 5(*a*) is a separate view of the receptacle connector of the connector assembly shown in FIG. 2.
Figure 5A:
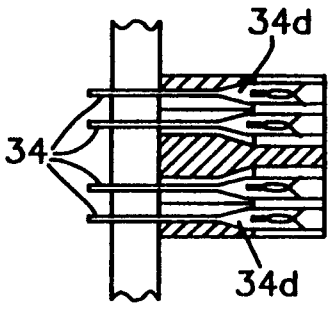

Turning now to FIGS. 5(*a*), 5(*b*) and also still referring to FIGS. 1, 2 and 4, the details of the receptacle connector 18 are more fully described. A plurality of electrical contacts 34 are arranged in four rows, two outer rows of contacts 34a and two inner rows of contacts 34b for complementary mating with the contacts of the plug connector 16. Contacts 34 are preferably formed of a resilient copper alloy material, such as beryllium copper or phosphor bronze, and each comprises a mateable terminal portion 34c for disengageable mating with pins 20c in the plug connector. Terminal portions 34c are preferably formed of double-beam sockets for resilient, friction receipt of the pins 20c, as depicted in FIG. 2. Opposite ends of each of the contacts 34 further preferably comprise a compliant, resilient section 34d for suitable press-fit connection in openings in the motherboard 12, for removable separation thereto. Pressure or surface mount connections may also be made. If removeability is not desired, tail portions 34d may be formed as a pin for a suitable solder connection to the motherboard 12.

The receptacle contacts 34 are supported preferably in two sets of two rows by insulators 36, each insulator supporting an outer row of contacts 34*a* and an inner row of contacts 34*b*. While the insulator 36 supporting each set of contacts 34*a* and 34*b* may be unitarily formed of a suitable dielectric material, insulator 36 may be formed of separate insulator strips. For example, as shown in FIG. 2, strip 36*a* may support outer rows of contacts 34*a*, strip 36*b* may support inner row of contacts 34*b* and a strip 36*c* may cover the terminal portion sockets 34*c*. Whether formed as a unitary material or composite, dielectric material is provided around each of the contacts 34*a* and 34*b* and between each inner row and outer row of contacts. In each set of inner rows and outer rows of contacts, the outer rows of contacts 34*a* are staggered with respect to the inner row of contacts 34*b*, to not only mate with the respective contacts 20*a* and 20*b* of the plug connector, but also to provide the higher density construction as set forth hereinabove.

Similar also to the insulators 22 of the plug connector, the insulators 36 supporting each set of inner and outer rows of contacts are provided with a plurality of notches 38, preferably in V-shape configuration, extending partially into each insulator transversely from its exterior surface thereof and between each of the adjacent contacts 34*a*, 34*b*.

The receptacle connector further comprises a conductive housing 40 for EMI shielding and for supporting the insulators 36 with contacts 34 therein. Housing 40 is preferably formed of cast metal, such as zinc, aluminum or brass and is of rectangular configuration complementary to the rectangular configuration of the plug connector housing 26. Housing 40 comprises a pair of spaced opposing sidewalls 40*a* and a pair of transversely extending, opposed endwalls 40*b*. Interiorly of the conductive housing 40 are a pair of spaced cavities 40*c* extending therein, an interior section 40*d* of the housing extending between the cavities 40*c*, as depicted in FIGS. 2 and 5(*b*). The insulators 36 supporting each set of inner and outer rows of contacts are suitably received in the cavities 40*c*, in interference fit or by other suitable retention means, one insulator 36 being received in each cavity 40*c*. Similar to the conductive housing 26 of the plug connector, conductive housing 40 comprises a plurality of inwardly directed projections 42, preferably of V-shaped configuration complementary with the insulator notches 38. The projections 42 and notches 38 formed in a manner as described with respect to the plug connector in FIG. 4, project inwardly from the outer sidewalls 40*a* partially between each of the outer row of contacts 34*a* and outwardly from the interior housing section 40*d* partially between the adjacent contacts 34*b* of the inner row. As the conductive housing 40 is suitably attached to a conductive trace on motherhood 12, a grounded, conductive barrier is thus provided between adjacent contacts in the inner and outer rows 34*a*, 34*b*, respectively, to provide a conductive barrier for low cross-talk capability.

The interior housing section 40*d* is formed to have a surface 40*e* that is provided substantially flush with the insulators 36 adjacent the terminal portions 34*c* of the contacts 34. The sidewalls 40*a* and the endwalls 40*b* are formed to a shorter extent, thereby exposing a length 36*a* (see FIG. 1) of the insulators 36 at their exterior surfaces thereof. In part, the sidewalls 40*a* do not extend outwardly over the terminal portions 34*c* inasmuch as the preferred construction of dual-beam sockets would require a wider housing wall section thereabout for shielding. Thus, the illustrated construction provides a receptacle connector of preferably narrower width.

For purposes of the characteristic impedance, the sidewalls 40*c* and the inner housing section 40*d* being suitably attached to the conductive ground trace on the motherhood 12 serve as a ground plane for the receptacle connector 18. In a manner as described with respect to FIG. 4, the spacing between the outer rows of contacts 34*a* and the sidewalls 38*a* as well as the spacing between the inner rows of contacts 34*b* and the inner housing section 40*d* are provided to be substantially constant and as close in dimension as practicable to spacings $d_1$ and $d_2$, respectively. Thus these spacings, together with the selection of the dielectric constant of the material of the insulators 36 are used to determine the desired characteristic impedance in accordance with the recognized theory of strip line signal transmission. As such, a receptacle connector with a characteristic impedance of 50 ohms to match the backplane connector impedance of 50 ohms may be achieved. Likewise, variations may be made in the characteristic impedance of the receptacle connector to match other backplane impedances where desired.

At the location where the exterior surfaces 36*a* of the insulators 36 are not covered by a ground plane as provided by sidewalls 40*a*, when the receptacle connector 18 and the plug connector 16 are suitably mated, the projecting housing section 32 extends over such exposed exterior portions 36*a* thereby providing an exterior ground plane about the exterior of the terminal portions 34*c* of the contacts 34. The spacing between the terminal portions 34*c* and the section 32 of the plug connector housing 26 is provided to be on the order of the spacing $d_2$ as described with respect to FIG. 4. Further, as noted hereinabove, the section 32 comprises inwardly directed projections 28 that enter complementarily formed notches 38 so as to provide low cross-talk protection in this area of the receptacle connector.

Having described the preferred embodiment of the connector assembly herein, it can be appreciated that variations may be made thereto without departing from the contemplated scope of the invention. As such, the preferred embodiment described herein is intended to be illustrative rather than limiting, the true scope of the invention being set forth in the claims appended hereto.

We claim:

1. An electrical connector for use in electrically interconnecting circuits on two printed circuit boards, said connector being electrically mateable with a complementary connector electrically connected to one of said boards, said electrical connector comprising:

a plurality of contacts arranged in two, substantially parallel, elongate rows, said contacts in one row being staggered with respect to said contacts in said other row, each contact including a tail portion for electrical engagement with a circuit on the other of said boards and an opposing mateable terminal portion for electrical engagement with a contact of said complementary connector, an insulator supporting said two rows of contacts, said insulator being formed of dielectric material, dielectric material surrounding each of said contacts and extending between each row of contacts;

a conductive housing on said insulator and extending along said insulator exteriorly of said rows of contacts, and spaced from each row of contacts a distance to provide with the dielectric constant of the material of said insulator, a selected characteristic impedance, a plurality of conductive members in engagement with said housing extending transversely into said insulator from the exterior thereof and partially between each of said respective contacts so as to provide a conductive barrier for minimizing crosstalk between adjacent contacts within a row.

2. An electrical connector according to claim 1, wherein said insulator has a plurality of inwardly directed notches, said conductive members each respectively extending into said notches.

3. An electrical connector according to claim 2, wherein said conductive members are formed of one-piece, integral metal with said conductive housing, said members projecting from said housing into said respective notches.

4. An electrical connector according to claim 3, wherein said notches are each formed generally in V-shape configuration, the wider portion of said V-shape opening at the exterior of said insulator, said projecting members being formed in complementary generally, V-shape configuration.

5. An electrical connector according to claim 1, wherein said mateable portion of each contact comprises engagement means by which each contact is disengageably mateable with a contact of said complementary connector.

6. An electrical connector according to claim 1, wherein said insulator comprises dielectric material formed unitarily around both rows of contacts.

7. An electrical connector according to claim 1, wherein said insulator comprises dielectric material formed separately around each of said rows of contacts.

8. An electrical connector assembly comprising a receptacle connector and a plug connector for use in electrically interconnecting circuits on two printed circuit boards, each connector comprising:

a first set of contacts arranged in two, substantially parallel, elongate rows, one row defining a first outer row of contacts and the other row defining a first inner row of contacts, the contacts of said two rows being longitudinally staggered relative to each other;

a first elongate insulator of dielectric material supporting said first set of contacts, dielectric material surrounding each of said contacts and extending between said rows of contacts, each of said contacts having a tail portion projecting from said first insulator for electrical engagement with a circuit on one of said boards;

a second set of contacts arranged in two, substantially parallel, elongate rows, one row defining a second outer row of contacts and the other row defining a second inner row of contacts, the contacts of said two rows being longitudinally staggered relative to each other;

a second elongate insulator of dielectric material supporting said second set of contacts, dielectric material surrounding each of said contacts and extending between said rows of contacts, each of the contacts having a tail portion projecting from said second insulator for electrical engagement with a circuit on the other of said boards; and a conductive housing supporting said first insulator and said second insulator in spaced disposition with said first inner row of contacts and said second inner row of contacts facing each other, an inner portion of said housing extending between said first and second insulators and having projections transversely extending partially between the contacts of said first and second inner rows of contacts, an outer portion of said housing extending exteriorly of said first and second insulators and having projections transversely extending partially between the contacts of said first and second outer rows of contacts.

9. An electrical connector assembly according to claim 8, wherein said conductive housing is formed of cast metal and substantially surrounds said first insulator and said second insulator.

10. An electrical connector assembly according to claim 9, wherein said conductive housing has two spaced cavities extending therein, one cavity receiving said first insulator and the other cavity receiving said second insulator.

11. An electrical connector assembly according to claim 10, wherein each of said first and second insulators has a plurality of inwardly directed notches located substantially between adjacent contacts, said projections on said housing extending respectively into said notches, said notches and said projections being of common, complementary configuration.

12. An electrical connector assembly for use in electrically interconnecting circuits on two printed circuit boards, comprising:

a receptacle connector comprising an elongate insulator of dielectric material supporting at least two, substantially parallel rows of contacts, each contact having a tail portion projecting from said insulator for engagement with a circuit on one of said boards and an opposing mateable terminal portion, the contacts in the rows being longitudinally staggered relative to each other, and a conductive housing supporting said insulator and having a plurality of projections extending transversely toward and partially between said contacts in each row, a portion of said insulator extending outwardly beyond said housing; and a plug connector comprising an elongate insulator of dielectric material supporting at least two, substantially parallel rows of contacts, each contact having a tail portion projecting from the insulator for engagement with a circuit on the other of said boards and an opposing terminal portion disengageably mated with a respective mateable terminal of said receptacle connector, the contacts in said rows being longitudinally staggered relative to each other, and a conductive housing supporting said insulator and having a plurality of projections extending transversely toward and partially between said contacts in each row, a portion of said housing extending outwardly beyond said insulator and exteriorly over said portion of said insulator projecting outwardly beyond said receptacle connector housing.

13. An electrical connector assembly according to claim 12, wherein said two printed circuit boards define a motherboard and a daughterboard arranged to be interconnected in an orthogonal manner, and wherein said contacts of said receptacle connector are to be electrically engaged with circuits on said motherboard and wherein said contacts of said plug connector as to be electrically engaged with circuits on said daughterboard.

14. An electrical connector assembly according to claim 13, wherein said tail portions of said receptacle connector contacts comprise compliant means for separable, friction fit engagement with openings in said motherboard.

15. An electrical connector assembly according to claim 14, wherein said tail portions of said plug connector contacts comprise exposed, resilient, cantilevered ends for separable, pressure contact with said daughterboard.

16. An electrical connector assembly according to claim 15, wherein the contacts in one row of said two rows of contacts of said plug connector are longer than the contacts in the other row.

17. An electrical connector assembly according to claim 16, wherein dielectric material extends along rows of contacts in differing lengths.

18. An electrical connector assembly according to claim 13, wherein said portion of said plug connector conductive housing extending outwardly beyond said insulator, further extends over an outer portion of the conductive housing of said receptacle connector.

19. An electrical connector assembly according to claim 16, wherein said conductive housing of said plug connector comprises a conductive backshell having extent covering the longer of said two rows of contacts.

20. An electrical connector assembly according to claim 19, wherein said conductive backshell comprises means for engaging and supporting said daughterboard.

* * * * *